United States Patent [19]

Hood et al.

[11] Patent Number: 4,744,198

[45] Date of Patent: May 17, 1988

[54] ROLL WRAPPING HEAD STORAGE AND DELIVERY APPARATUS AND METHOD

[75] Inventors: Stephen K. Hood, Hoquiam; Joseph Norkoski, Cosmopolis; Halan P. Arnold, Aberdeen, all of Wash.

[73] Assignee: Engerprises International, Inc., Hoquiam, Wash.

[21] Appl. No.: 898,530

[22] Filed: Aug. 21, 1986

[51] Int. Cl.[4] ..... B65B 61/00

[52] U.S. Cl. ..... 53/415; 53/137; 53/211; 53/465; 271/91; 414/280

[58] Field of Search ..... 53/129, 415, 130, 419, 53/137, 465, 139.3, 580, 211, 581, 397, 461; 271/91, 93; 414/224, 268, 225, 280, 276

[56] References Cited

U.S. PATENT DOCUMENTS

| | | | |
|---|---|---|---|
| 2,756,049 | 7/1956 | Stolz | 271/91 X |
| 2,890,043 | 6/1959 | Bruns . | |
| 3,227,290 | 1/1966 | Lemelson . | |
| 3,411,269 | 11/1968 | Karr . | |
| 3,411,640 | 11/1968 | Wallis | 271/91 X |
| 3,809,389 | 5/1974 | Wirz | 271/91 |
| 3,866,764 | 2/1975 | Leiser | 271/91 X |
| 3,892,400 | 7/1975 | Harrison . | |
| 4,108,933 | 8/1978 | Goransson et al. . | |
| 4,195,737 | 4/1980 | Rysti | 414/276 X |
| 4,303,462 | 12/1981 | Karr | 53/137 X |
| 4,311,304 | 1/1982 | Hamada et al. | 271/91 X |
| 4,339,904 | 7/1982 | Koutonen et al. . | |
| 4,485,612 | 12/1984 | Piesen et al. | 53/211 X |
| 4,534,151 | 8/1985 | Schneck et al. . | |
| 4,596,108 | 6/1986 | Piesen et al. | 53/137 |
| 4,679,376 | 7/1987 | Ekblom | 53/137 |

FOREIGN PATENT DOCUMENTS 1275440 8/1968 Fed. Rep. of Germany .

*Primary Examiner*—Robert L. Spruill
*Assistant Examiner*—Steven P. Weihrouch
*Attorney, Agent, or Firm*—Seed and Berry

[57] ABSTRACT

A total system and method for storage and delivery of heads of various sizes is disclosed. The system and method are particularly adapted for application of circular disc heads to the end of a paper roll during a roll wrapping operation. A plurality of vertically spaced storage racks are provided for handling different sized heads, and a head dispenser including a pickup mechanism for lifting an uppermost head from a storage rack and delivering it to a pickup platen is also provided. The storage racks are preferably inclined to allow gravity feed to indexing positions at the lower ends of each rack. The pickup platen operates independently of the pickup mechanism so that heads can be lifted from the storage rack while the platen is enroute to the pickup location.

27 Claims, 6 Drawing Sheets

FIG. 1
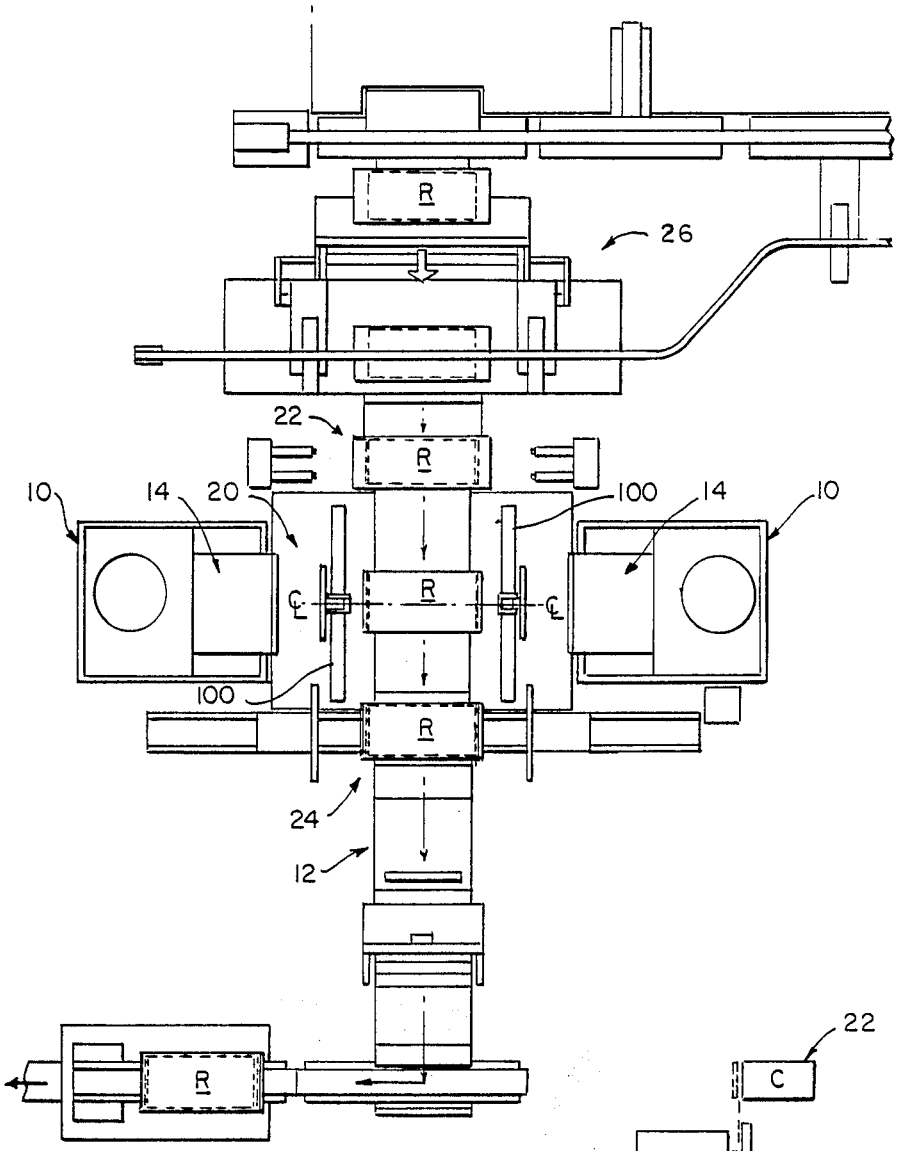
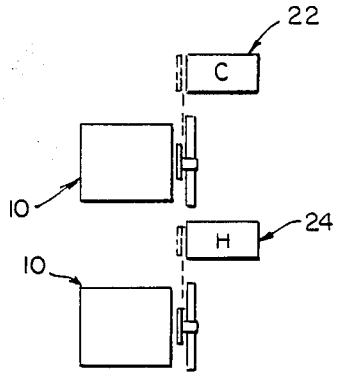
FIG. 1A

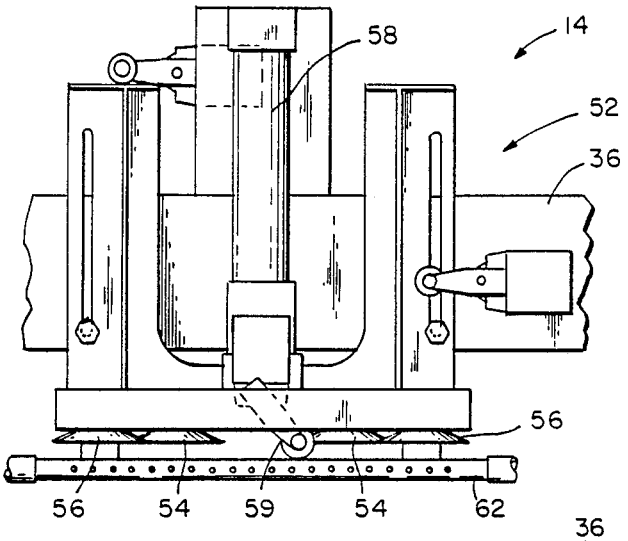
FIG. 9
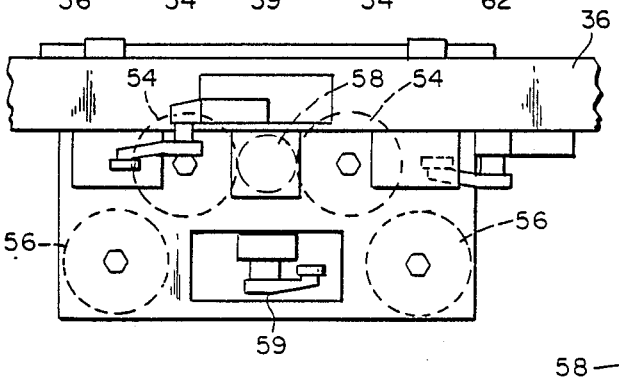
FIG. 10
FIG. 12
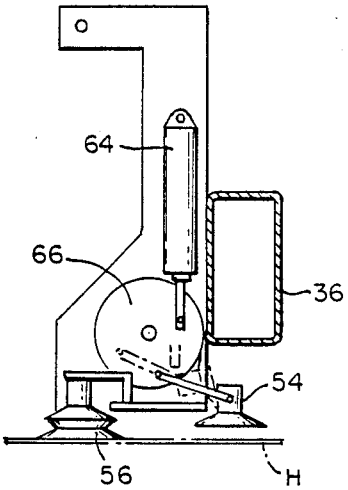
FIG. 11
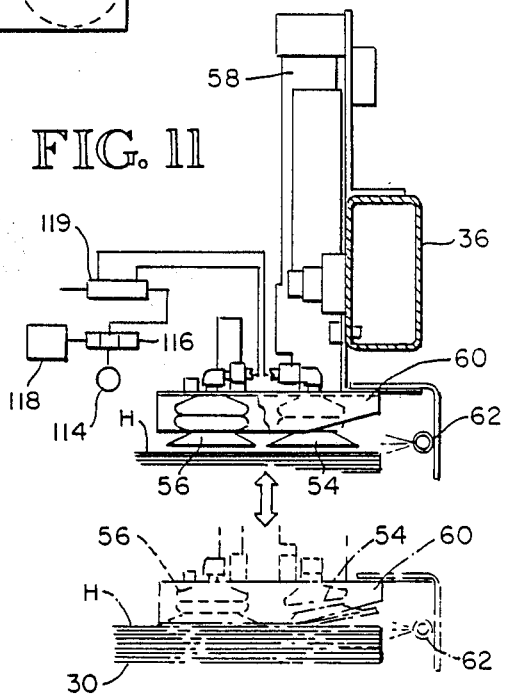

FIG. 13
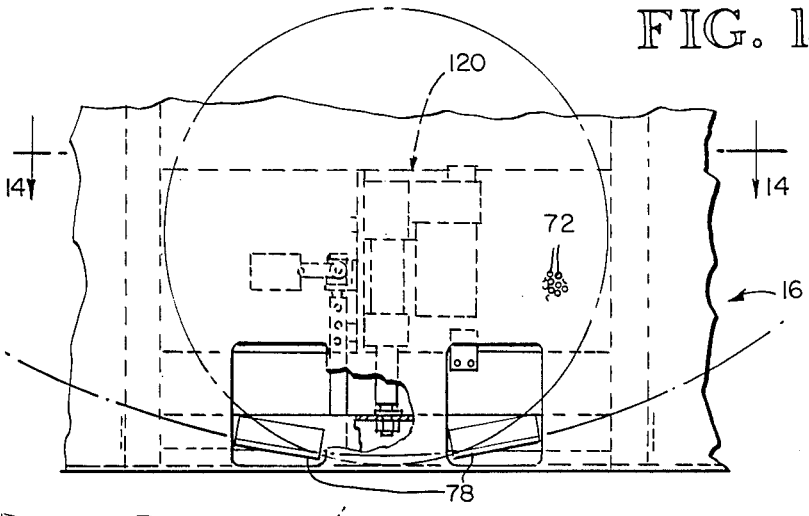
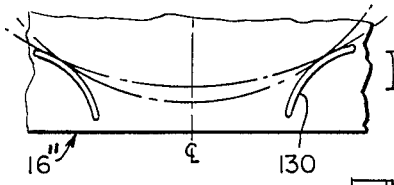
FIG. 13A
FIG. 14
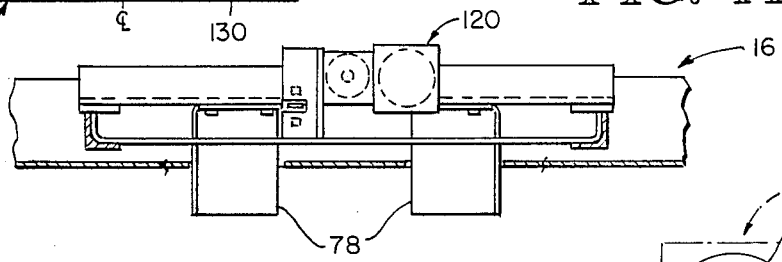
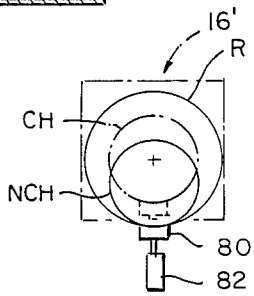
FIG. 13B
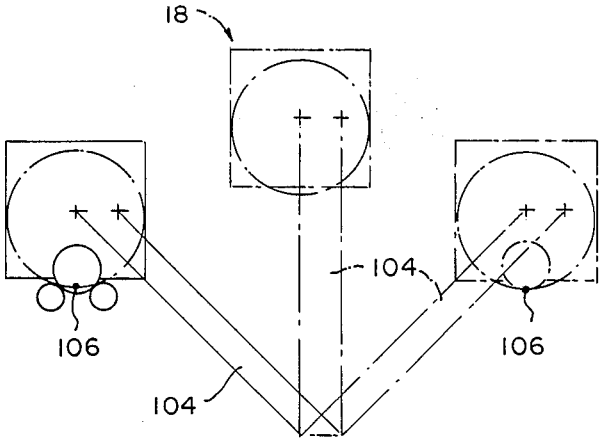
FIG. 15

ROLL WRAPPING HEAD STORAGE AND DELIVERY APPARATUS AND METHOD

DESCRIPTION

1. Technical Field

This invention relates to head (protective covering for the end of an object to be wrapped) applying apparatus, and more particularly, to head storage and delivery apparatus and methods in which a variety of different size heads can be automatically delivered to a placement location, such as at a crimper or header of a roll wrapping system.

2. Background Art

Roll wrapping systems and other packaging systems which require the application of a protective head on the end of the object, such as a paper roll, have generally been confined to a single diameter head or a manual selection of different diameter heads and manual delivery of that head to the placement position.

Some attempts have been made to automate the head storage and delivery system. U.S. Pat. No. 4,339,904 is directed to a head storage and delivery system in which different sized heads are stored on movable storage racks. The storage racks swing out of the storage position where the topmost head of a stack is picked up by a transfer arm and the arm transfers the head to a placement position adjacent a header. This type of system is cumbersome to use. A somewhat similar system is shown in West German Auslegetag No. 1,275,440. In this system, a transfer arm moves the topmost head from a single stack. The transfer arm is an articulated arm that can swing about a first axis to move the head laterally in the plane of the head. The arm can bend down also at 90° perpendicular onto the plane of the head to pick the head off the stack and position it for movement onto the head applying machine.

Various other techniques have been attempted, such as by using a turntable carrying different diameter heads, each of which can be selectively indexed to a pickup and transfer position. In one prior art system, the stacks were stored on an elevator, with the uppermost head being delivered to a ramp. A transfer arm swung down to lift the head off the ramp and then pivoted to deliver the head laterally to the plane of the head to a placement position.

While the above prior art attempts at automation have had some level of success, none has been totally satisfactory.

DISCLOSURE OF THE INVENTION

It is an object of this invention to provide a total system and method for storage and delivery of heads of various sizes, particularly circular disc heads for application to the end of a paper roll during a roll wrapping operation. In addition, several of the components of the total system are uniquely usable and adapted for other head storage and delivery systems.

Thus it is an object to provide a storage rack system that requires minor attendance by a manual operator and which can quickly select and deliver a desired diameter head to a location where it can be picked up by a transfer arm and delivered to the final placement position. This feature of the invention is best accomplished by providing a plurality of vertically spaced storage racks for handling different sized heads, and a head dispenser including a pickup mechanism for lifting an uppermost head from a storage rack and delivering it to a pickup platen which positions the selected head in an exact orientated condition prior to the head being lifted by the transfer arm mechanism to move the head to the final placement position.

The storage racks are preferably inclined to allow gravity feed to indexing positions at the lower ends of each rack. The pickup platen operates independently of the pickup mechanism so that heads can be lifted from the storage rack while the platen is enroute to the pickup location. This advantageously speeds up delivery of the heads from the various storage racks.

The transfer arm mechanism for transferring the selected head from the pickup platen to the final placement position is designed to move between two relatively preestablished positions. It is essential for an effective head delivery system to bring the head to the final placement position in an exact orientation and alignment with respect to the object on which the head will be applied. This orientation and alignment are accomplished at the pickup platen, where the selected head is registered exactly in an alignment simulating its position at the head placement position. The alignment and rotational orientation are representative of the actual alignment and orientation of the object relative to the conveyor that supports the object. Particularly for applying disc-type heads for paper rolls being wrapped, the orientation and alignment are important because the diameter of the paper roll will vary, changing its tangential peripheral location relative to the conveyor rollers which are supporting the paper roll. A small paper roll will protrude further down between the gap between the rollers on which the paper roll is supported than will a large diameter paper roll. These differences are accounted for in the pickup platen and are maintained by the unique transfer arm mechanism.

The transfer arm mechanism has as its object efficient transfer of the head between the pickup platen and the final placement position with the ability to maintain the orientation and alignment achieved at the pickup platen. The transfer arm also has as its object to be capable of delivering heads to one or, in the preferred embodiment, two adjacent head applying mechanisms, such as a header and a crimper. The orientation of the head is uniquely maintained by use of a parallelogram linkage on the transfer arm which maintains the orientation of the referencing point of the head in the exact same position that the head had in the pickup platen.

The transfer arm mechanism has two axis of movement, namely, a first axis which allows the transfer arm to swing toward and away from the platen in a direction perpendicular to the head on the platen, and a second axis of orientation, which transfers the head laterally in the plane of the head from the pickup position to the final placement position. In a preferred embodiment, a third horizontal axis is provided which moves the entire transfer mechanism laterally to either side of a central storage rack so that heads can be delivered to either a crimper or a header.

Since the heads for roll wrapping machines are of different diameters, three embodiments of an indexing or referencing mechanism are shown on the pickup platen to assure accurate simulation of the orientation and location of the head at the pickup platen so that it is the same as the roll on the roll wrapping supporting rollers. In one embodiment, guides simulating actual roll peripheries are placed at the bottom of the pickup platen so that the disc at the pickup platen sits in the same position as it would were it sitting on supporting rollers at the head placement location. In a second embodiment, an automatic head indexing stop is provided to position the lower peripheral edge of the head at any desired point. This latter embodiment is particularly useful where undersized heads are to be applied to a paper roll. The undersized head will be shifted upwardly on the pickup platen automatically to align the head on the pickup platen in a position simulating centering of the head on the central longitudinal axis of the paper roll that is being wrapped. In a third embodiment, programmable, spaced, flat, movable guides are substituted for the single indexing stop.

The head dispenser pickup mechanism is uniquely employed with suction cups that bend up a peripheral edge of the topmost head in a stack of heads to facilitate separation of the uppermost head from the stack. Heads will vary in weight and porosity, making some heads more difficult to separate from the stack than others. Multiple vacuum levels can also be applied to selective of these suction cups to handle these variations in weight and porosity. In addition, the unique bending of the peripheral edge allows air to enter between the top two adjacent heads, making separation much easier. In one embodiment, an air shower blows air between the uppermost head and the next adjacent head. In another embodiment, the bending is made dramatically pronounced such that the air shower is not necessary.

Delivery of the head to the placement position at a crimper is facilitated by providing an extendable transfer frame at the crimping station. The transfer frame is uniquely provided with vertically spaced vacuum cups, the uppermost cups being movable toward and away from the lower cups. In this manner, the upper cups can be adjusted to contact the uppermost peripheral edge of the head being delivered, regardless of its diameter. The transfer frame than can deliver the head in a direction axial to the longitudinal axis of the paper roll and place the head inside the overhand of the wrapper that will be on the paper roll. A brush then holds the head in engagement with the paper roll as the vacuum cups are retracted, leaving the head in a position for a crimper to come down and crimp the overhand wrapper about the head in a well-known manner.

These various components, while in themselves unique and advantageous, together enable a synergistic system to be provided and a synergistic overall method of storing, delivering and positioning at final placement positions a large variety of various sized heads for objects to be wrapped.

BRIEF DESCRIPTION OF THE DRAWINGS

FIG. 1 is a schematic floor plan of a preferred embodiment of the head storage and delivery apparatus and capable of carrying out the method of the invention.

FIG. 1A is a schematic floor plan showing a second alternative embodiment of the system.

FIG. 9 is a detail of a pickup mechanism used on the head dispenser shown in FIG. 4.

FIG. 10 is a top plan view of the pickup mechanism shown in FIG. 9.

FIG. 11 is a side elevation view of the pickup mechanism showing in operational schematics positioning of the pickup mechanism onto and removed from a stack of heads and also shows tilting of the head away from the stack.

FIG. 12 is a fragmentary detail of a modified form of the pickup mechanism.

FIG. 13 is a fragmentary view of the pickup platen showing programmable, adjustable head stops for simulating the position of a head on the paper roll supported on powered rollers at the header or crimper and particularly useful in positioning an undersized head to center the head in a simulated position of alignment with the center of the paper roll on its supporting rollers.

FIG. 13A shows fixed indexing stops shaped and spaced to simulate the rollers supporting the object to be wrapped at the head placement position.

FIG. 13B shows another programmable single indexing stop.

FIG. 14 is an end view of the pickup platen of FIG. 13.

FIG. 15 is a schematic illustration of the transferring arm showing the parallelogram linkage for maintaining alignment and orientation of the head from the pickup platen to the final placement position.

BEST MODE FOR CARRYING OUT THE INVENTION

Figure 2:
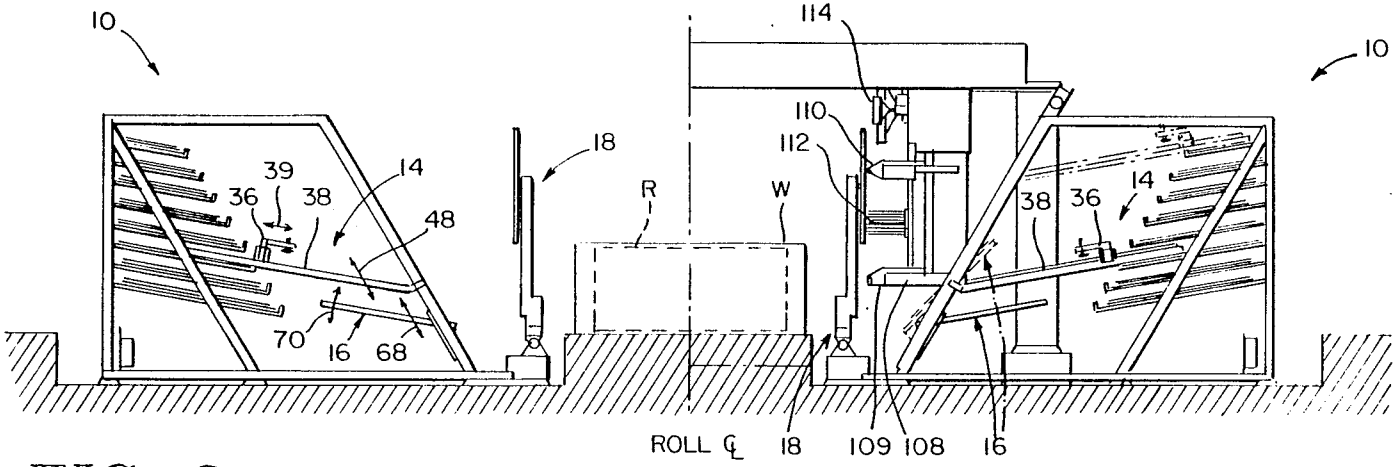
FIG. 2 is a side elevation of the apparatus shown in FIG. 1 illustrating a head storage and delivery apparatus on either side of a paper roll carrying conveyor.

As best shown in FIGS. 1 and 2, the storage and delivery system includes a head storage rack assembly 10, one on either side of a roll carrying conveyor 12, a head dispenser 14, a pickup platen 16 (FIG. 2), a transfer arm mechanism 18 capable of moving the head from a pickup position 20 to a final placement position.

In the embodiment illustrated in FIG. 1, there is a second final placement position 24 at, for example, a header 24, with the first final placement position being located at a crimper 22. There are two storage racks, dispensers, pickup platens and transfer arm mechanisms on either side of the roll carrying conveyor 12. It is understood, therefore, that the description of one system will apply equally to a system on the opposite side of the conveyor. In the embodiment shown in FIG. 1, the transfer arm mechanism has three axes of movement. The third axis is longitudinal along the conveyor so that the transfer arm can position heads from the pickup platen laterally either to the crimper or to the header. In some installations, it may be more productive to have a separate storage rack assembly, dispenser, pickup platen, transfer arm mechanism for each placement position. This is illustrated in FIG. 1A, where one storage and delivery apparatus is applied for a crimper and a separate storage and delivery apparatus is applied to a header. It is also apparent, however, that in some installations only a header or only a crimper may be used. In such event, only a single storage and delivery apparatus, one on each side of the conveyor, will be used.

In the embodiment illustrated in FIG. 1, objects R, such as paper rolls, are carried along the conveyor 12 through a wrapper and band applying station 26, where they are delivered to the crimper 22 with a wrapper W overhanging the opposite ends of the paper roll. At the crimper, an inside smaller diameter head is placed on the ends of the roll and the overhand wrapper is crimped over the inside head, then glue is applied to the overhang. The crimper is of a well-known type with only a few modifications to accommodate automatic head placement, as will be later described. The roll is then advanced to the header 24, where additional heads are applied to the outside of the crimped and glued ends. Finally, the paper roll is removed from the header station and transferred further down the conveyor 12.

Figure 4:
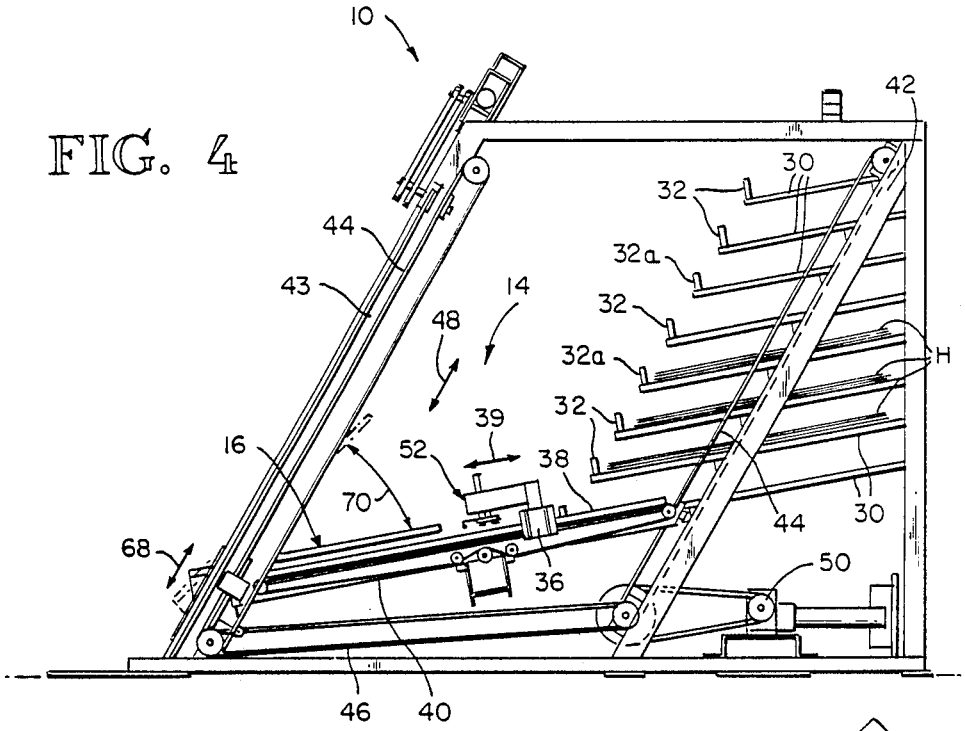
FIG. 4 is a side elevation of the storage rack assembly and head dispenser.
Figure 5:
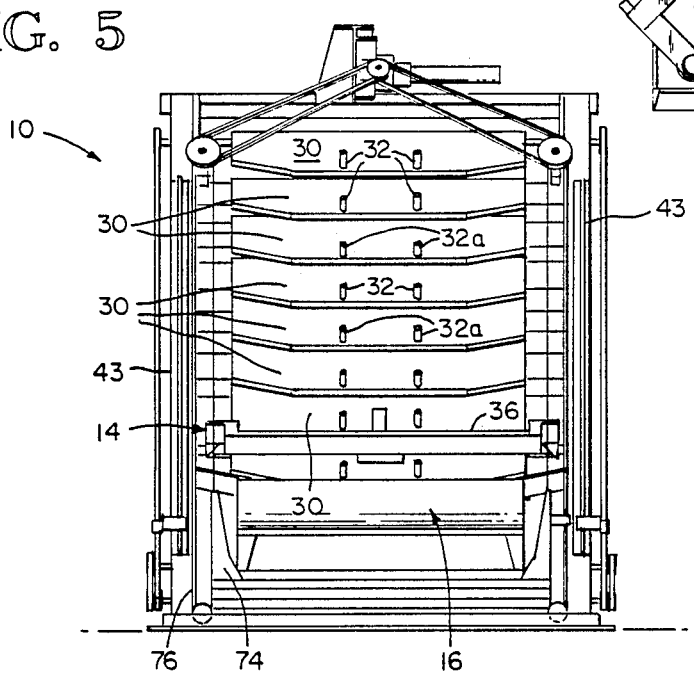
FIG. 5 is a front elevation of the storage rack assembly and head dispenser.

The storage rack assembly is best shown in FIGS. 4 and 5 and includes a plurality of inclined shelves or racks 30 of different sizes to accommodate different sized heads, particularly flat disc-type heads for protecting the ends of paper rolls. Each rack holds a stack of heads H of various diameters. The racks are inclined to allow the heads to slide by gravity to their lower ends, where positioning pins 32 position the lower ends of the stack at the lower edge of the rack. The pins are bolted to the racks on an eccentric axis so they can be rotated and shifted inwardly and outwardly as at 32*a*. This allows accommodation of large diameter heads or small diameter heads while maintaining the lower peripheral edge of the edge more closely aligned with the lower edge of the rack. That is, by moving the pins closer together, a smaller diameter head will be shifted upwardly rather than allowing the smaller diameter to protrude downwardly beyond the lower edge of the rack, as if the pins were spaced more widely apart. It is desirable to position the heads in all the racks with their lower edges all at the same approximate location. This allows the head dispenser to move to the same location to pick up each head, thus simplifying the control functions of the pickup head of the dispenser, as will be described.

Figure 3A:
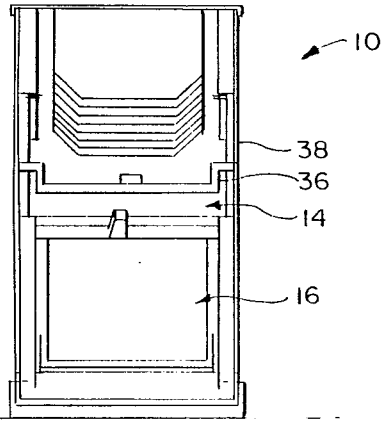
FIG. 3A is a plan view of the storage and delivery apparatus.
Figure 3:
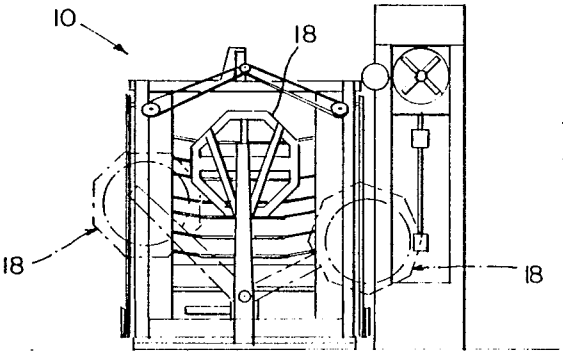
FIG. 3 is a front elevation of a head storage and delivery apparatus shown positioning a head at a crimper station.

The head dispenser includes a U-shaped pickup frame 36 (FIG. 3A). The frame runs on two laterally spaced rails 38 and moves toward and away from the racks, as shown by the arrow 39 in FIG. 2. The pickup frame 36 is powered along the rails by a rubber timing belt drive 40. The rails 38 are themselves vertically reciprocally mounted on front and rear vertical frame rails 43 and 42. The rails 38 are driven vertically along the forward and rearward frame rails in the direction of arrow 48 by timing belts 44 that are driven in synchronism by a common timing belt 46 powered by a motor 50. Mounted on the U-shaped pickup frame 36 is a pickup shoe or head 52. In the embodiment of the pickup head 52 shown in FIGS. 9, 10 and 11, the head carries a plurality of forward suction cups 54 and rearward suction cups 56. A pneumatic cylinder and piston 58 lowers and raises the suction cups until a switch 59 contacts the uppermost head in a stack. The suction cups are then energized, drawing a suction to attach the uppermost most head to the suction cups. As best shown in FIG. 11, the forward suction cups 54 are extended downwardly beyond an inclined backing frame 60. When the suction is applied and a head is covering the end of the suction cups 54, the cups collapse, drawing upwardly until they hit the backing frame. Since the backing frame 60 is inclined further upwardly, the forward cups 54 bend the lower peripheral edge of the head upwardly further off the stack of heads. In the event, because of the porosity of the head material, the suction is drawing the nextmost adjacent head from the stack, or due to static charges between the heads the next uppermost head is attached to the lifted head, the bending of the forward edge breaks the attraction forces and is generally enough to separate the lifted uppermost head from the sticking head. In some instances, an air shower 62 may be used to blow air between the bent upper edge and the stack to help assist in separating the uppermost head. The pickup head moves over the lower edge of the head that is to be raised. Because the eccentric pins 32 maintain the lower edge of the heads in each storage shelf at the same point, the pickup head can be easily programmed to preferably engage the head always near the lower edge.

In the embodiment shown in FIG. 12, an additional cylinder in piston 64 is connected to a circular link 66 that is then linked to the forwardmost suction cups 54. In this embodiment, extension of the piston rod rotates the forwardmost suction cup 54 into the phantom line position, producing an almost 90° bend on the head. This aggravated amount of bend is generally sufficient without an air shower to separate the uppermost head from the stack.

The pickup platen 16 is best shown in FIGS. 2, 13, 13A, 13B and 14. The pickup platen moves vertically in the direction of arrow 68 and pivots about a horizontal axis in the direction of arrow 70. The platen is a large, smooth, rectangular plate, preferably provided with apertures 72 (shown schematically in FIG. 13) to provide an air float surface on the upper surface of the plate. A highly polished surface may suffice without the need for an air float surface, if desired. The pickup platen is mounted in a frame 74 (FIG. 5) that rides on the inside of the vertical rails 43. The pickup platen is independently powered on the rails 43 by a timing belt drive 76.

As best shown in FIG. 13, the lower end of the pickup platen 16 is provided with adjustable guide stops 78. The guide stops are spaced and shaped to simulate the spacing and shape of the rolls carrying the paper roll at the heading and crimping stations. These guides are adjustably mounted on the plate and can be replaced to match the roll shapes of each customer's installation. Movement is by a programmable actuator 120 that moves the guide stops in the plane of the platen to position the lower edge of the head. The guide stops can also be adjusted laterally to change the gap between the guide stops. By matching the guide stops to the roll shape and spacing at the head placement position, the head can be positioned on the platen in the exact same position as it will be placed on the roll resting on the rollers at the placement position. Thus, if a smaller diameter head is placed on the guides 78, its lower peripheral surface will extend downwardly further than a larger diameter head. Since this relationship exists for the paper roll resting on the rollers at the placement position, it is apparent that the head will be maintained on the platen at the same position as it will be placed on the paper roll.

FIG. 13A shows adjustable guide stops 130 on a modified platen 16″ that have the exact same curved profile and spacing as the rollers at the header or crimping station.

Since the variety of paper rolls varies infinitely, it is impossible to provide an equal number of exact same diameter heads. Thus, the head size will frequently be of the next smaller diameter than the paper roll. A smaller diameter head would then have its center positioned lower than the center of the paper roll. To accommodate this mismatch, both the embodiments of FIGS. 13 and 13B have adjustable guide stops. FIG. 13B shows a platen 16 having an adjustable guide stop 80 that is positioned by a programmable adjustment mechanism 82. FIG. 13B shows the approximate relative shape and position of a paper roll resting on rollers at the head positioning station. The phantom line circle CH shows a centered head having been shifted upwardly by the adjusting mechanism and adjustable guide stop 80. The smaller circle in solid lines identified with the characters in CH is a non-centered head which would show where its off-center relationship would be relative to the paper roll PR if it had not been shifted by the adjustable guide stop 80.

Figure 6:
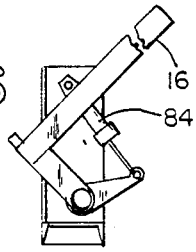
FIG. 6 is a fragmentary view of a pickup platen used with the head dispenser shown in FIGS. 4 and 5.

The pickup platen is pivoted by a pneumatic cylinder and piston mechanism 84 to its elevated position, about 45° as it is shown in FIG. 6 from a lowered position, about 10°, as it is shown in FIG. 4. In the pivotally lowered position in FIG. 4, the platen is in the condition in which it receives a head from the pickup head 52. In the pivotally elevated position shown in FIG. 6, the platen is raised so that the head that is now carried on the platen slides down to the guide stops 78 or 80. Thus, the pickup platen becomes a critical alignment and orientation station to position the head for its subsequent transfer to the transfer arm and to the final placement position. In essence, all of the orientation and alignment occurs at the pickup platen, with this alignment and orientation being maintained by the transfer arm.

Figure 7:
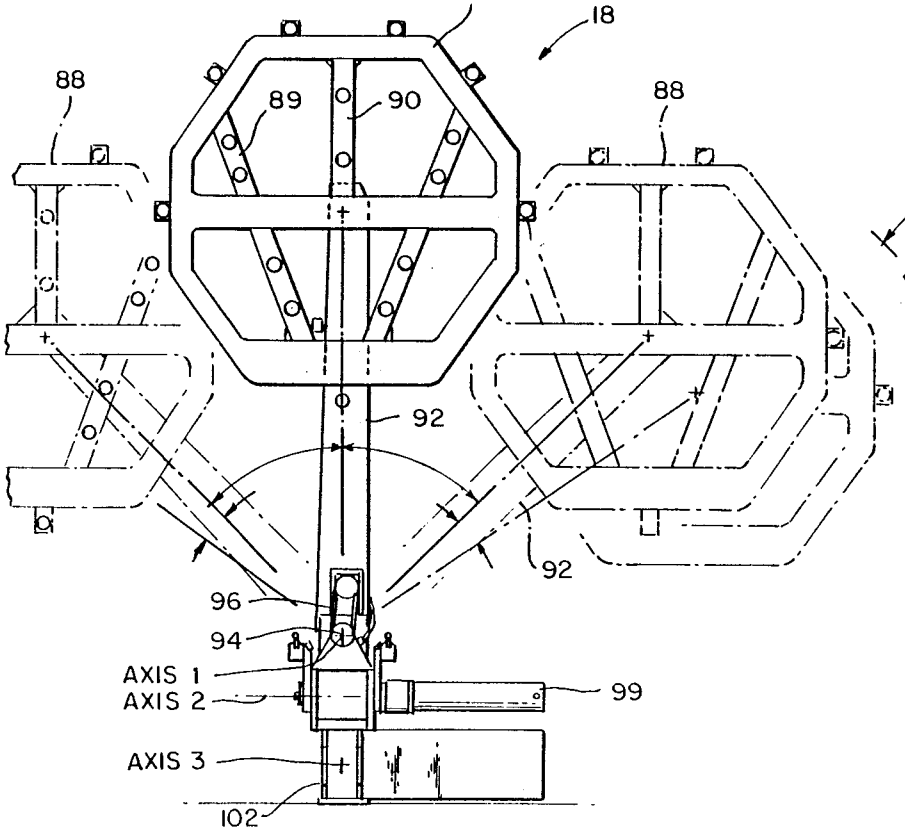
FIG. 7 is a front elevation of a transfer arm mechanism.

The transfer arm mechanism 18 includes a suction head frame 88 (FIG. 7) having a V-shaped array of suction cups 89 and a center array 90. These suction cups are selectively energized, depending upon the size of the head. If it is a small diameter head, only the lowermost suction cups are energized, whereas all of the suction cups would be energized for a large diameter head. The suction head frame is carried on an arm 92 that is pivoted about a first axis 94. This axis of movement swings the head parallel to the plane of the head and the plane of the head from a pickup position where it is aligned with the pickup platen to a final placement position where it is aligned with a paper roll at the header or crimper station. Pivoting occurs through a small servomotor drive 96. The arm 92 also pivots about a second axis 98, which pivots the arm perpendicular to the plane of the head down to the pickup platen and vertically. This drive is also by a small servomotor 99. Finally, in the embodiment shown in FIG. 1, the arm can travel along a track 100 by a further drive 102. This drive is a conventional linear drive which reciprocates the arm along the track between the two final positioning stations such as a header and a crimper.

The transfer arm is coupled to the suction head frame 88 by parallelogram links 104. As best shown in FIG. 15, these parallel links take a register point 106 on the head and maintain that register point at its exact same orientation as it was positioned at the platen as the head is moved from the platen position to the final placement position.

A typical sequence of operations of the storage and head delivery system will now be described. Heads are manually placed in the various racks according to their diameters. The pickup head 52 is moved upwardly to the desired storage rack and the pickup head moved over the lowermost edge of the heads on the desired stack. The pickup platen will independently follow the pickup head up to the desired rack. The pickup head is lowered and the suction applied to the suction cups to lift and bend the lower forward edge of the uppermost head on the stack. The pickup head then lifts the uppermost head to clear the pins 32 and brings the head down over the platen. The suction is then terminated and the head falls onto the platen and the pickup head returns to a central position on the frame so it is clear of the platen. The platen has, in the meantime, lowered itself to its lower position, as shown in FIG. 4. The platen then pivots upwardly into the position shown in FIG. 6, with the head carried on the platen sliding down on the air surface into the guide stops. The guide stops position the head in a position simulating how the head would be placed on the paper roll. If the head is undersized, its position will be adjusted by the programmable guide stop 80.

Figure 8:
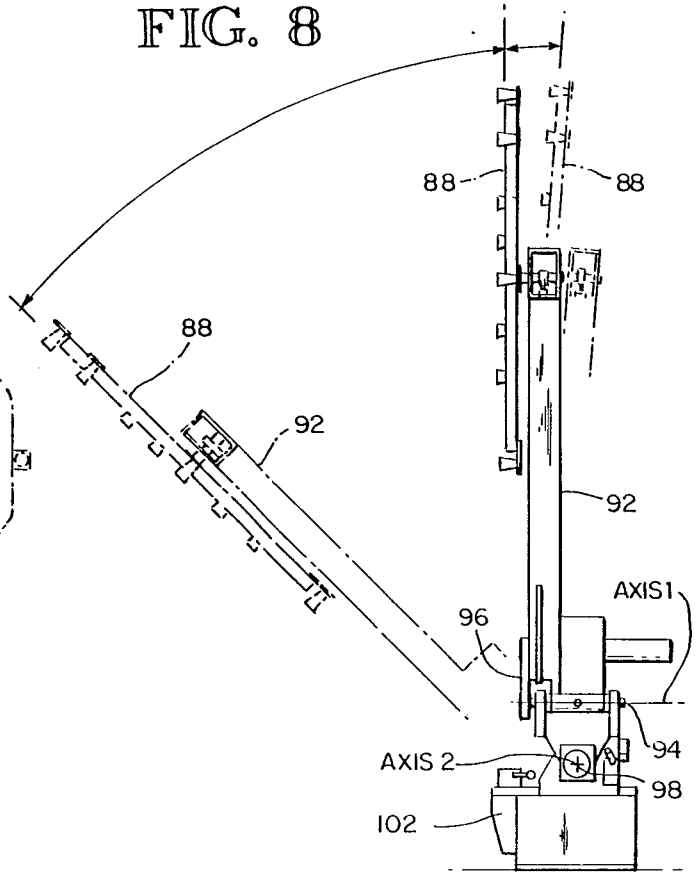
FIG. 8 is a side elevation of a transfer arm mechanism.

As soon as the platen has been elevated and has positioned the head, the transfer arm mechanism swings the suction head frame about axis 98 and energizes the suction cups on the head frame. The suction cups attach to the head on the platen and the head is then lifted by the transfer arm to beyond a vertical position, as shown in FIG. 8. The transfer arm is then pivoted about axis 94 and the parallelogram linkage maintains the index reference point on the head in its same lower position as it was on the platen. The transfer arm swings the head either to the left or to the right to the final placement position in alignment with the paper roll or other object upon which the head will be applied. At the final placement position, the head transfer arm then pivots again about axis 98 a few degrees, as shown in FIG. 8, to place the head onto the suction cups at the header or crimper station. The suction is then terminated on the suction head frame and the transfer arm is wung back to the platen position.

When the transfer arm is used for delivering heads to two stations spaced on opposite sides of the storage racks, and if the stations are spaced too far to be reached merely by swinging the arm, the third axis of movement moves the transfer arm laterally to the station upon which the final placement position will occur. That is, if the head is to be delivered to the crimper, the transfer arm is moved along the track toward the crimper before it swings to pick up the head on the platen. It is desirable to swing the heads out of the platen position and into the final placement position by pivoting about axis 94 so that the head can clear the mechanisms at the crimper and header station upon which the head may be rested.

While a conventional header can be used, the crimping apparatus in a roll wrapping system has particular problems. At this station, the paper roll has a wrapper overhang as shown in FIG. 2. Thus it is necessary to move the head inside the overhang while it is placed on the end of the roll. To accomplish this, the crimping station is uniquely provided with a crimper suction head frame 108 which has a set of lower suction cups 109 and vertically adjustable upper suction cups 110. The upper suction cups are positionable, depending on the diameter of the head, to engage the upper end of the head. The entire crimper suction head frame is movable toward and away from the paper roll. A brush 112 will continue to hold the head against the end of the paper roll when the suction cups 109 and 110 are retracted. The crimper 114 thus can be lowered to crimp the overhang of the wrapper and glue the crimped overhang, as is conventional practice.

A typical system for providing suction to the various suction cups throughout the system is shown in FIG. 11. Air is delivered from an air supply 114 to a multiple set of values 116 which are controlled by a programmable controller 118. Air is then directed to venturi suction generators 119 to produce suction at the desired suction cups. The numbers and location of the suction cups that are energized can be controlled, as well as the amount of suction generated at each cup. This is particularly useful for handling heads having varying weights and porosity. The components of the venturi generating system are of themselves conventional and the details will not be described.

The apparatus as described is useful in providing the unique method of storing and transporting round, flat heads to placement locations. The method includes holding a variety of different sized heads at vertically spaced locations, automatically carrying a selected head from a selected storage location to a single intermediate orienting location, then automatically carrying the head from the orienting location to a final placement position. At the orienting position, the heads are allowed to slide by gravity to an alignment and orientation simulating their alignment and orientation at the paper roll. The heads are removed from the orienting and alignment location by swinging the head upwardly and forwardly perpendicularly to the plane of the head about a first axis of rotation, then swinging the head laterally generally in the plane of the head about a second axis rotation to the final placement location. During this step of swinging the head laterally, the orientation of the head is maintained by simultaneously rotating the head about its center axis so that an index point on the head will remain in the same rotational position at the intermediate orienting position to the final placement position.

In a preferred embodiment of the method, the transferring step is first provided with the additional step of linearly shifting the axis of rotation of the swinging movement laterally from the intermediate orientation position to one side or the other thereof so that the swinging movement into a final placement position can occur on either side of the orienting and alignment station.

While the preferred embodiments of the invention have been illustrated and described, it should be understood that variations will be apparent to one skilled in the art without departing from the principles herein. Accordingly, the invention is not to be limited to the specific embodiment illustrated in the drawing.

We claim:

1. Head storage and delivery apparatus for moving an individual head from stacks of heads to a placement location on a package wrapping header or crimper, comprising:

a storage rack assembly;

a plurality of vertically spaced storage racks in the storage rack assembly for holding the heads;

a pickup mechanism for lifting an individual head from any rack while in the storage rack assembly and delivering the head to a platen separate from the storage rack; and a transfer arm for lifting the head from the platen and placing the head at the placement location.

2. The head storage and delivery apparatus of claim 1 wherein said pickup mechanism moves vertically along the racks, parallel to the racks and between the racks, and said platen moves vertically independently of said pickup mechanism, whereby the pickup mechanism and the platen can move simultaneously for increased performance.

3. The head storage and delivery apparatus of claim 1, said platen being tiltable about a horizontal axis, said transfer arm being pivotable about a first axis to move a head from the platen location to the placement location, said transfer arm being pivotable about a second axis to tilt and remove a head from the platen at the platen location and to tilt and deliver a head at the placement location.

4. The head storage and delivery apparatus of claim 1, said transfer arm having three axes of movement, namely, a first axis, in which the arm pivots between a platen location and a placement location, a second axis for pivoting downwardly to pick up and deliver heads, and a third axis for traversing horizontally to opposite sides of said platen location, whereby a single storage rack and transfer arm can service two head applying machines horizontally spaced on either side of said storage racks.

5. The head storage and delivery apparatus of claim 1, said transfer arm including a head holding frame having a plurality of vacuum cups for holding a head, an elongated linkage for supporting said head holding frame, means for pivoting said linkage about a horizontal axis to move the head holding frame between a platen position and a placement position, said linkage including parallelogram links pivotal together, whereby a register point on said head holding frame will maintain the same rotational orientation about the center of rotation of the head holding frame in both said platen position and said placement position.

6. The head storage and delivery apparatus of claim 1, said pickup mechanism and said transfer arm using vacuum to pick up heads and carry the heads from the storage racks to the placement position, and including means for varying the vacuum to provide increased or decreased vacuum, depending on the porosity and weight of a head.

7. The head storage and delivery apparatus of claim 1, said pickup mechanism including a plurality of suction cups, a first of said cups being closer to the edge of a head on the storage body than a second of such cups, and means for positioning the first suction cup so that it lifts the edge of a head off the storage rack a greater distance than the second cup for bending the head and breaking the bond between adjacent heads stacked on said rack.

8. The head storage and delivery apparatus of claim 7, including means for blowing air against said lifted bent edge of the head to help separate the lifted head from a stack of heads on the storage rack.

9. The head storage and delivery apparatus of claim 1 wherein said racks have a lower end and are tilted so as to cause heads stored thereon to slide downward to said lower end.

10. The head storage and delivery apparatus of claim 9 wherein said pickup mechanism moves vertically along the racks and parallel to the racks and said platen moves vertically independently of said pickup mechanism, whereby the pickup mechanism and the platen can move simultaneously for increased performance.

11. The head storage and delivery apparatus of claim 10, said platen being tiltable about a horizontal axis, said transfer arm being pivotable about a first axis to move a head from the platen location to the placement location, said transfer arm being pivotable about a second axis to reach down and remove a head from the platen and to tilt and deliver a head at the placement location.

12. The head storage and delivery apparatus of claim 11, said transfer arm including a head holding frame having a plurality of vacuum cups for holding a head, an elongated linkage for supporting said head holding frame, means for pivoting said linkage about a horizontal axis to move the head holding frame between a platen position and a placement position, said linkage including parallelogram links pivotal together, whereby a register point on said head holding frame will maintain the same rotational orientation relative to rotation about the center of the head holding frame in both said platen position and said placement position.

13. The head storage and delivery apparatus of claim 12, said pickup mechanism and said transfer arm using vacuum to pick up heads and carry the heads from the storage racks to the placement position, and including means for varying the vacuum to provide increased or decreased vacuum, depending on the porosity and weight of a head.

14. Head storage and delivery apparatus for moving an individual head from stacks of heads to a placement location on a package wrapping header or crimper, comprising:

a plurality of vertically spaced storage racks for holding the heads;

a pickup mechanism for lifting a head from any rack and delivering the head to a platen;

a transfer arm for lifting the head from the platen and placing the head at the placement location; and said platen including an adjustable stop means for adjusting the lower edge of a head on the platen to a position that centers the head relative to the object upon which the head is to be placed.

15. Head storage and delivery apparatus for moving an individual head from stacks of heads to a placement location on a package wrapping header or crimper, comprising:

a plurality of vertically spaced storage racks for holding the heads, said racks having a lower end and being tilted so as to cause heads stored thereon to slide downward to said lower end;

a pickup mechanism for lifting a head from any rack and delivering the head to a platen, said mechanism moving vertically along the racks and parallel to the racks;

said platen moving vertically independently of said pickup mechanism, whereby the pickup mechanism and the platen can move simultaneously for increased performance;

a transfer arm for lifting the head from the platen and placing the head at the placement location;

said platen being tiltable about a horizontal axis, said transfer arm being pivotable about a first axis to move a head from the platen location to the placement location, said transfer arm being pivotable about a second axis to reach down and remove a head from the platen and to tilt and deliver a head at the placement location; and said platen including an adjustable stop means for adjusting the lower edge of a head on the platen to a position that centers the head relative to the object upon which the head is to be placed.

16. Head storage and delivery apparatus for positioning heads of any shape to objects having an end of similar shape, including a platen for receiving a head from a storage location and having a length direction, a movable indexing stop movable along the length direction of the platen for engaging the head and positioning the lower edge of the head along the length direction of the platen so that the center of the head will be aligned with the center of the end of the object, and a transfer arm for removing the head from the platen in its center aligned position and transferring the head to a placement position adjacent the object, with the center of the head remaining aligned with the center of the object irrespective of differences in sizes between the head and the end of the object.

17. The head storage and delivery apparatus of claim 16 wherein the object is a cylindrical paper roll and the head is a round disc, said platen being inclined so that the disc slides downwardly into engagement with the indexing stop, with the lower edge of the disc being located upwardly along the length direction of the platen by the movable indexing stop if the disc is of a diameter smaller than the paper roll diameter.

18. Head storage and delivery apparatus for positioning heads from an orienting position to a placement position where the head is aligned with a paper roll resting on a pair of spaced rollers, comprising a platen inclined to allow the heads to slide downwardly by gravity, a pair of spaced indexing stops of the same spacing and profile as the rollers to simulate the rollers and cause the head to be positioned on the indexing stops in the exact same relationship as the head would be positioned relative to the rollers, whereby a head will be located at the orienting position as if on the paper roll on the rollers, and a transfer arm for lifting and moving the head to the placement position in the same position relative to the paper roll supporting rollers as was the head position relative to the indexing stops.

19. A vacuum pickup mechanism for lifting a topmost head from a stack of heads, comprising at least two suction cups, a first cup positioned adjacent to an edge of the head and a second cup positioned inwardly of the first cup toward the center of the head, and means for causing the first suction cup to lift the edge of the head more than the second cup to bend the edge of the head upwardly and separate the top head from the stack, said means for causing the first suction cup to lift the edge of the head more than the second cup including a recessed inclined guide surface positioned around the first cup, said first cup collapsing under the suction when engaged with a head until the head is bent against the inclined guide surface.

20. The mechanism of claim 19, including an air jet for blowing air between the upwardly bent edge of the head and the remaining head in the stack to help separate the topmost head.

21. The mechanism of claim 19, said means for causing the first suction cup to lift the edge of the head more than the second cup including a linkage mechanism for pivoting the first section cup upwardly.

22. A transfer arm mechanism for transporting a flat head for covering the end of an object to the end of the object from an orienting location to a placement location without changing the rotational orientation about the head's axis of rotation, said flat head having an axis of rotation perpendicular to the plane of the head, including an orienting location where the head is positioned at its correct orientation relative to its final position on the object, a head holding frame for lifting the head at its orienting location, a pair of parallelogram links for pivotally supporting the head holding frame, and means for simultaneously pivoting the parallelogram links for moving the head holding frame between the orienting location to the final position while maintaining the same rotational orientation of the head about its own axis of rotation throughout said movement.

23. The transfer arm transfer mechanism of claim 22 wherein said head is a round disc and said object is a cylindrical roll of paper, said head having a predetermined register point to match the same point on the paper roll, said parallelogram links maintaining the orientation of the register point on the head so that it is positioned on the paper roll in the same orientation.

24. A method of storing and transporting flat heads that have a center of rotation perpendicular to the flat plane of the head to a placement location at a roll wrapping station, comprising:

holding the flat heads at vertically spaced storage locations;

separating a selected head from all other heads at the vertically spaced storage locations;

automatically carrying the selected head from the storage location to a single intermediate orienting location; and automatically carrying the head from the orienting location to a final placement location while maintaining the same rotational orientation of the head about the center of rotation of the head.

25. The method of claim 24, said step of carrying the head from the orienting location to the placement location including swinging the head upwardly and forwardly perpendicular to the plane of the head about a first axis of rotation, and swinging the head laterally generally in the plane of the head about a second axis of rotation to the final placement location.

26. The method of claim 25, including the step of swinging the head rearwardly perpendicular to the plane of the head at the final placement location, and transferring the head at the final placement location to a head applying device.

27. The method of claim 25, including the step of shifting the second axis laterally to either side of orienting location prior to swinging the head about said second axis, whereby the head can be positioned at either of two final placement locations spaced on opposite sides of said orienting position.

* * * * *